US010250989B1

(12) United States Patent
Xiao et al.

(10) Patent No.: US 10,250,989 B1
(45) Date of Patent: Apr. 2, 2019

(54) MICRO SOUND GENERATING DEVICE AND METHOD OF ASSEMBLING SAME

(71) Applicant: AAC Technologies Pte. Ltd., Singapore (SG)

(72) Inventors: Bo Xiao, Shenzhen (CN); Ronglin Linghu, Shenzhen (CN)

(73) Assignee: AAC TECHNOLOGIES PTE. LTD., Singapore (SG)

( * ) Notice: Subject to any disclaimer, the term of this patent is extended or adjusted under 35 U.S.C. 154(b) by 0 days.

(21) Appl. No.: 16/055,839

(22) Filed: Aug. 6, 2018

(30) Foreign Application Priority Data

Nov. 23, 2017 (CN) ..... 2017 1 1182786

(51) Int. Cl.
*H04R 1/02* (2006.01)
*H04R 9/02* (2006.01)
*H04R 9/06* (2006.01)
*H04R 23/00* (2006.01)

(52) U.S. Cl.
CPC ..... *H04R 9/025* (2013.01); *H04R 1/02* (2013.01); *H04R 9/06* (2013.01); *H04R 23/008* (2013.01); *H04R 2499/11* (2013.01)

(58) Field of Classification Search
CPC . H04R 9/025; H04R 1/02; H04R 9/06; H04R 23/008; H04R 2499/11
USPC ..... 381/396
See application file for complete search history.

(56) References Cited

U.S. PATENT DOCUMENTS 9,813,821 B1 * 11/2017 Song ..... H04R 9/06
2005/0220320 A1 * 10/2005 Kim ..... H04R 9/025 381/396
2009/0278644 A1 * 11/2009 Ueda ..... B06B 1/045 335/302
2014/0056465 A1 * 2/2014 Li ..... H04R 9/025 381/400
2015/0010196 A1 * 1/2015 Lee ..... H04R 9/025 381/412
2015/0156590 A1 * 6/2015 Kono ..... H04R 1/06 381/398

* cited by examiner

*Primary Examiner* — Sean H Nguyen
(74) *Attorney, Agent, or Firm* — Na Xu; IPro, PLLC

(57) ABSTRACT

A micro sound generating device is provided in the present disclosure. The micro sound generating device includes a vibrating system, a magnetic circuit system, and a frame for receiving and fixing the vibrating system and the magnetic circuit system, the vibrating system comprises a diaphragm, a voice coil driving the diaphragm to vibrate, and a support connected with the voice coil, the diaphragm and the support are located on two opposite sides of the voice coil, respectively, and the support and the frame are formed integrally. At the same time, the present disclosure also provides a method for assembling the micro sound generating device as described above.

11 Claims, 6 Drawing Sheets

MICRO SOUND GENERATING DEVICE AND METHOD OF ASSEMBLING SAME

FIELD OF THE DISCLOSURE

The present disclosure relates to the technical field of speakers, and more particularly to a micro sound generating device as well as a method of assembling a micro sound generating device.

BACKGROUND

With the progress of science and technology, a variety of types of electronic devices are being gradually developed to be miniature and portable, causing indispensable components in such electronic devices as acoustic devices to develop to be more compact in structure and smaller in size. In this way, quality requirements for acoustic devices are increased accordingly.

In general, in a mini-type acoustic device, such as a micro sound generating device, a diaphragm is connected on a voice coil of the micro sound generating device so that the voice coil can drive the diaphragm to vibrate, thereby generating sound. At the same time, to reduce a swing amplitude of the voice coil in a vibration process so as to improve voice quality, a support is usually adhered to a lower portion of the voice coil, and then connected with a frame of the micro sound generator. Due to the addition of the support structure, it is also desired to connect the support with the voice coil and the frame respectively, so that a process of manufacturing the micro sound generating device becomes more complex.

Therefore, it is desired to provide a micro sound generating device as well as a method of assembling a micro sound generating device to overcome the aforesaid problems.

BRIEF DESCRIPTION OF THE DRAWINGS

Many aspects of the embodiments can be better understood with reference to the following drawings. The components in the drawing are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

Figure 1:
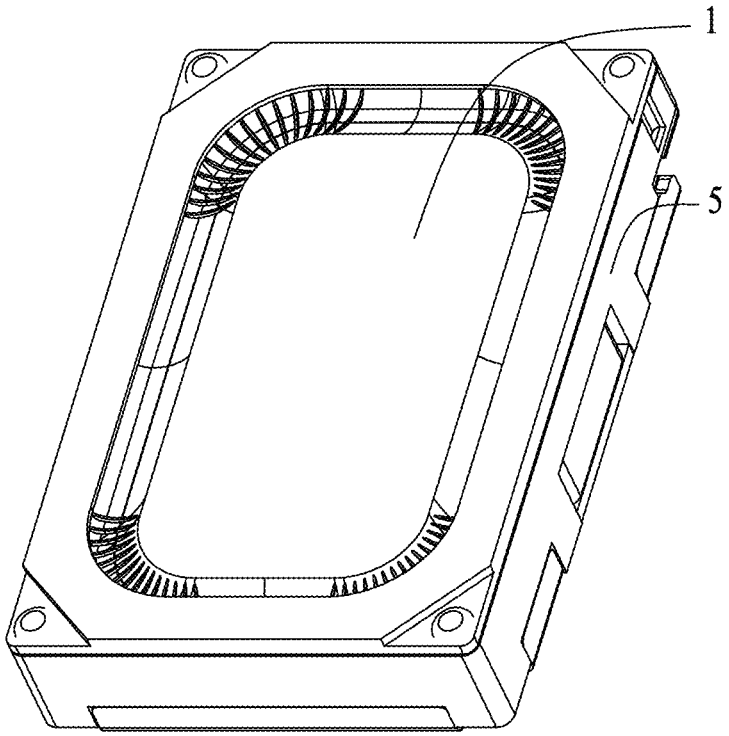
FIG. 1 is structure view of a micro sound generating device in accordance with an exemplary embodiment of the present disclosure.
Figure 2:
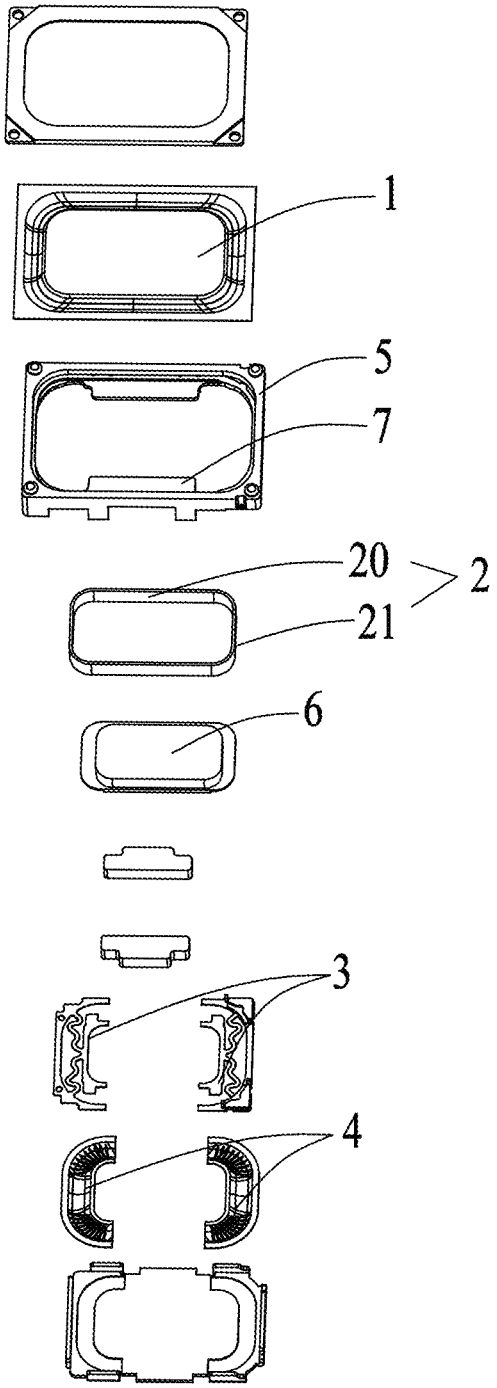
FIG. 2 is exploded view of a micro sound generating device in accordance with an exemplary embodiment of the present disclosure.
Figure 3:
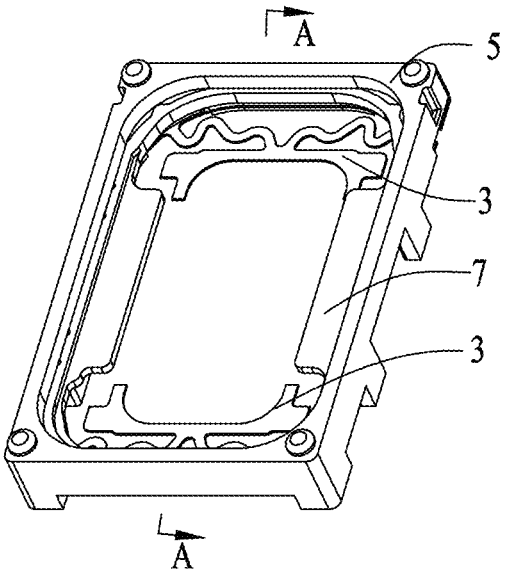
FIG. 3 is a schematic diagram of the partial structure of the micro sound generating device shown in FIG. 1.
Figure 4:
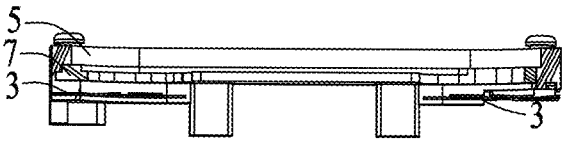
FIG. 4 is a sectional view of the micro sound generating device along A-A direction as shown in FIG. 3.

The present disclosure will be described in detail below with reference to the attached drawings and embodiments thereof.

As shown in FIGS. 1 to 8, an example of the present disclosure provides a micro sound generating device including a vibrating system, a magnetic circuit system, and a frame 5 for receiving and fixing the vibrating system and the magnetic circuit system. The vibrating system includes a diaphragm 1, a voice coil 2, and a support. The diaphragm 1 and the support may be located on two opposite sides of the voice coil 2, respectively. The frame 5 has a receiving space, and the diaphragm 1, the voice coil 2 and the magnetic circuit system may all be disposed in the receiving space of the frame 5. The support may be formed integrally with the frame 5, and the voice coil 2 may be supported on the support.

Specifically, the diaphragm 1 may be of a thin film structure made of a metal material, a high polymer material or the like, and the diaphragm 1 may be provide with a reinforcing rib. The voice coil 2 may be of a ring structure formed by winding a thin metal wire. The support may be of a plate-like structure made of a flexible material. The frame 5 may be of a frame structure that is made of a material such as plastic and has a receiving space. The magnetic circuit system may include a magnet and the like. The diaphragm 1 and the voice coil 2 may be connected in a glue bonding manner. The support and the frame 5 may be formed directly in an integrated injection molding manner, and one portion of the support may be connected to the frame 5 and another portion is bonded to the voice coil 2 by using a glue or the like, so that the voice coil 2 can be supported on the support. The diaphragm 1 and the support are provided on two opposite sides of the voice coil 2, respectively, so that the support supports the voice coil 2, lowering the swing amplitude of the voice coil 2 in a vibration process. Thus, sound quality is increased and user experience is improved.

As can be seen from the above, the support and the frame 5 are formed in an integrated forming manner. Therefore, the work of connecting the support and the frame 5 may be completed in a process of manufacturing the frame 5, saving the working procedure of connecting the support and the frame 5 separately required in the current manufacturing process of a micro sound generator. It is apparent that integrated formation of the support and the frame 5 can further simplify the whole process of manufacturing the micro sound generator. In addition, compared with the manner of bonding the support and the frame 5 by using a glue or the like, the manufacturing manner of integrally forming the support and the frame 5 can further improve the concentricity of the support and the frame 5, so that the voice coil 2 can receive a uniform pressure when the support supports the voice coil 2. In this way, the swing amplitude of the voice coil 2 is further reduced, eventually achieving the purpose of improving the sound quality.

Further, the voice coil 2 may include a pair of long edges 20 and a pair of short edges 21. The support may be provided at a side where a short edge 21 is located.

Specifically, the voice coil 2 may be of a rectangular ring-shaped structure. The rectangular voice coil 2 may have a pair of long edges 20 and a pair of short edges 21. Correspondingly, the diaphragm 1 and the frame 5 may also be rectangular or approximately rectangular. The support may include two portions, i.e., a first support and a second support. The first support and the second support may be arranged respectively on the sides where the pair of short edges 21 are located, and can support the two short edges 21 of the voice coil 2, respectively. Compared with a support of an integrated structure, the support including two portions may have the advantages of saving material and reducing the overall weight of the micro sound generator without losing its original function.

Figure 5:
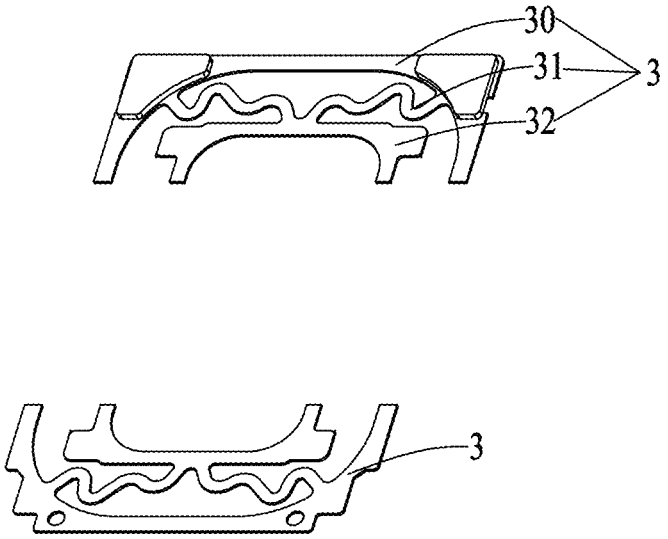
FIG. 5 is a schematic diagram of the flexible circuit board of the micro sound generating device shown in FIG. 1.

The voice coil 2 must be electrically connected with an external circuit to achieve conversion of electric energy and acoustic energy, and at the same time, the support is preferred to have a particular flexibility so as to elastically support the voice coil 2 vibrating in a reciprocating manner. Preferably, as shown in FIG. 5, the support may include a flexible circuit board 3. Of course, the support may also include other structures, or the support may also be other components. The voice coil 2 may be supported on the flexible circuit board 3, and the voice coil 2 may be electrically connected with the flexible circuit board 3.

Specifically, the flexible circuit board 3 may be provided with a conductive portion which is electrically connected with the voice coil 2 and an external circuit, respectively. With this design, the voice coil 2 may be electrically connected to the external circuit through the flexible circuit board 3, and the flexible circuit board 3 may elastically support the voice coil 2.

Further, the flexible circuit board 3 may include a first fixing portion 30, a first supporting portion 31, and a first elastic portion 32. The first fixing portion 30 may be connected with the frame 5. The first fixing portion 30 and the first supporting portion 31 may be connected by the first elastic portion 32. The voice coil 2 can be supported on the first supporting portion 31.

Specifically, the flexible circuit board 3 may be of an integrated structure. That is, each of the first fixing portion 30, the first elastic portion 32 and the first supporting portion 31 is a part of the flexible circuit board 3. The flexible circuit board 3 may also be of a split structure including three independent parts, i.e., the first fixing portion 30, the first supporting portion 31 and the first elastic portion 32, where the first fixing portion 30 and the first supporting portion 31 may be connected together by the first elastic portion 32. In the process of integrated injection molding of the frame 5 and the support, the first fixing portion 30 of the flexible circuit board 3 and the frame 5 may be directly formed integrally, and the first supporting portion 31 may be connected to the voice coil 2 by using a glue or the like so as to support the voice coil 2. More specifically, the flexible circuit board 3 may further be provided with a soldering pad, and the voice coil 2 may include a voice coil lead wire. The soldering pad may be connected with the voice coil lead wire for the purpose of electrically connecting the voice coil 2 and the flexible circuit board 3. Correspondingly, the flexible circuit board 3 may also be provided with a structure for electrical connection with an external circuit so as to electrically connect the voice coil 2 and the external circuit.

To prolong the service life of the flexible circuit board 3, the first fixing portion 30 and the first supporting portion 31 of the flexible circuit board 3 may be located on a same horizontal plane in a processing of integrated injection molding of the frame 5 and the flexible circuit board 3, so that the bending amplitude of the flexible circuit board 3 along with vibration of the voice coil 2 can be reduced.

Figure 6:
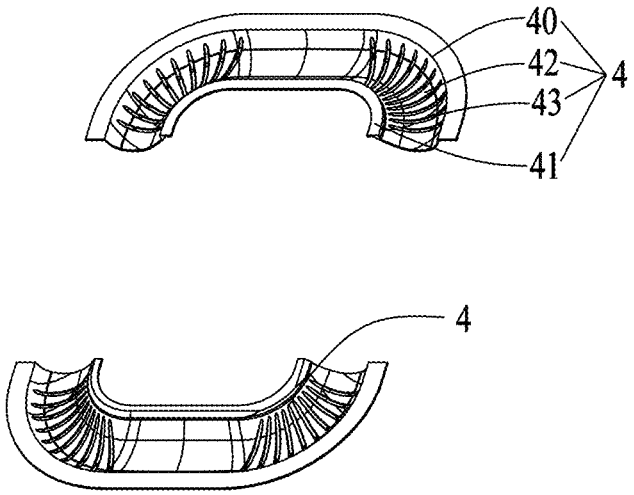
FIG. 6 is a schematic diagram of the elastic support part of the micro sound generating device shown in FIG. 1.

To further prolong the service life of the flexible circuit board 3, preferably, as shown in FIG. 6, the support may also include an elastic supporting portion 4. The first supporting portion 31 of the flexible circuit board 3 may be supported on the elastic supporting portion 4, and also the elastic supporting portion 4 may be formed integrally with the frame 5.

Specifically, the elastic supporting portion 4 may be a vibration diaphragm made of a thin film material, and may be formed integrally with the frame 5. In the manufacturing process of integrated injection molding, the first fixing portion 30 of the flexible circuit board 3 and a part of the elastic supporting portion 4 may be directly connected to corresponding positions of the frame 5. Thus, the manufacturing procedures may be reduced, and then the production efficiency may be improved. The elastic supporting portion 4 may support the flexible circuit board 3, and the voice coil 2, the flexible circuit board 3 and the elastic supporting portion 4 may be stacked in sequence in the thickness direction of the diaphragm 1. The elastic supporting portion 4 made of a flexible material may be provided in such a way that the elastic supporting portion 4 can share the weight of the voice coil 2 borne by the flexible circuit board 3 and a thrust force generated by reciprocating vibration of the voice coil 2. As a result, the service life of the flexible circuit board 3 may be further prolonged.

In a preferred example, two elastic supporting portions 4, i.e. a first elastic supporting portion and a second elastic supporting portion are provided. The first elastic supporting portion and the second elastic supporting portion may be same or different in structure. The first elastic supporting portion and the second elastic supporting portion that are different in structure may adjust damping balance of the whole support, and further ensure the supporting balance of the voice coil 2, so that the swing amplitude of the voice coil 2 in a vibration process can be effectively reduced so as to meet the design requirements of micro sound generators that are different in electrical connection manner or different in structure. Similarly, the first elastic supporting portion and the second elastic supporting portion may have the same structure but may be made of different thin film materials. In this way, the first elastic supporting portion and the second elastic supporting portion may be disposed asymmetrically. Certainly, the first elastic supporting portion and the second elastic supporting portion may also be of different structures made of different materials. In general, the swing amplitude of the micro sound generator at a low frequency may be more effectively reduced just by providing the first elastic supporting portion and the second elastic supporting portion made of different materials or having different structures; thus, the maximum low-frequency output sound pressure of the micro sound generator can be increased, and the low-frequency sound quality can be improved.

Further, an air vent 43 may be formed in the elastic supporting portion 4, and a first space and a second space may be formed on the two opposite sides of the elastic supporting portion 4, respectively. The first space and the second space may communicate with each other via the air vent 43.

Specifically, the air vent 43 may be formed in the elastic supporting portion 4 by using a hole puncher. To ensure that airflow can pass more smoothly, a plurality of air vents 43 may be formed. The two opposite sides of the elastic supporting portion 4 may be divided into the first space and the second space. Apparently, the first space and the second space may communicate with each other via the air vent 43. Moreover, a corresponding structure may be disposed on the frame 5, so that the internal space of the micro sound generator may communicate with external space via the vent hole 43. In this way, it may be ensured that the air pressures inside and outside the micro sound generator are the same, and air in the micro sound generator can be exchanged with external air, thereby achieving the purpose of accelerating heat dissipation.

Further, as shown in FIG. 6, the elastic supporting portion 4 may include a second fixing portion 40, a second supporting portion 41, and a recessing portion 42. The second fixing portion 40 may be connected with the frame 5. The second fixing portion 40 and the second supporting portion 41 may be connected by the recessing portion 42. The second supporting portion 41 may support the flexible circuit board 3.

Specifically, the elastic supporting portion 4 may be of an integrated structure. That is, each of the second fixing portion 40, the recessing portion 42 and the second supporting portion 41 is a part of the elastic supporting portion 4. The elastic supporting portion 4 may also be of a split structure. That is, the elastic supporting portion 4 may include three independent parts, i.e., the second fixing portion 40, the second supporting portion 41 and the recessing portion 42, where the second fixing portion 40 and the second supporting portion 41 may be connected by the recessing portion 42. During an injection molding process of the frame 5, the second fixing portion 40 of the elastic supporting portion 4 and the frame 5 may be directly connected together in an integrated forming manner, and the second supporting portion 41 may support the first supporting portion 31 of the flexible circuit board 3. The recessing portion 42 may correspond to a reinforcing structure on the diaphragm 1, so that a distance between each position of the diaphragm 1 and each corresponding position of the elastic supporting portion 4 is substantially same. As a result, when the diaphragm 1 vibrates, the pushed air may be more uniform, thereby improving the sound quality.

Since the elastic supporting portion 4 has the recessing portion 42, the second fixing portion 40 and the second supporting portion 41 may be located in two horizontal planes, respectively, and the second supporting portion 41 may be closer to the diaphragm 1 than the second fixing portion 40, so that the second supporting portion 41 can better support the first supporting portion 31. Further, the second supporting portion 41 has a trend to move close to the diaphragm 1. In addition, the first supporting portion 31 may be connected with the second supporting portion 41 by using a glue or the like.

Figure 7:
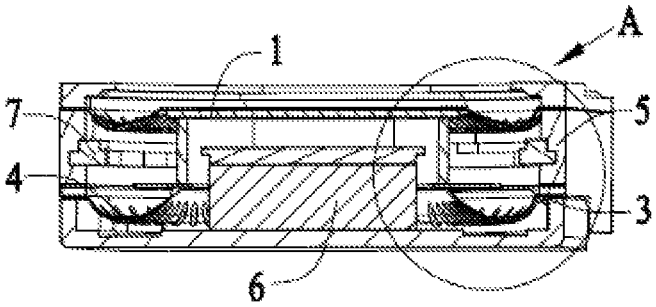
FIG. 7 is a sectional view of the sound generating device provided by the exemplary embodiment of the present disclosure shown in FIG. 1.
Figure 8:
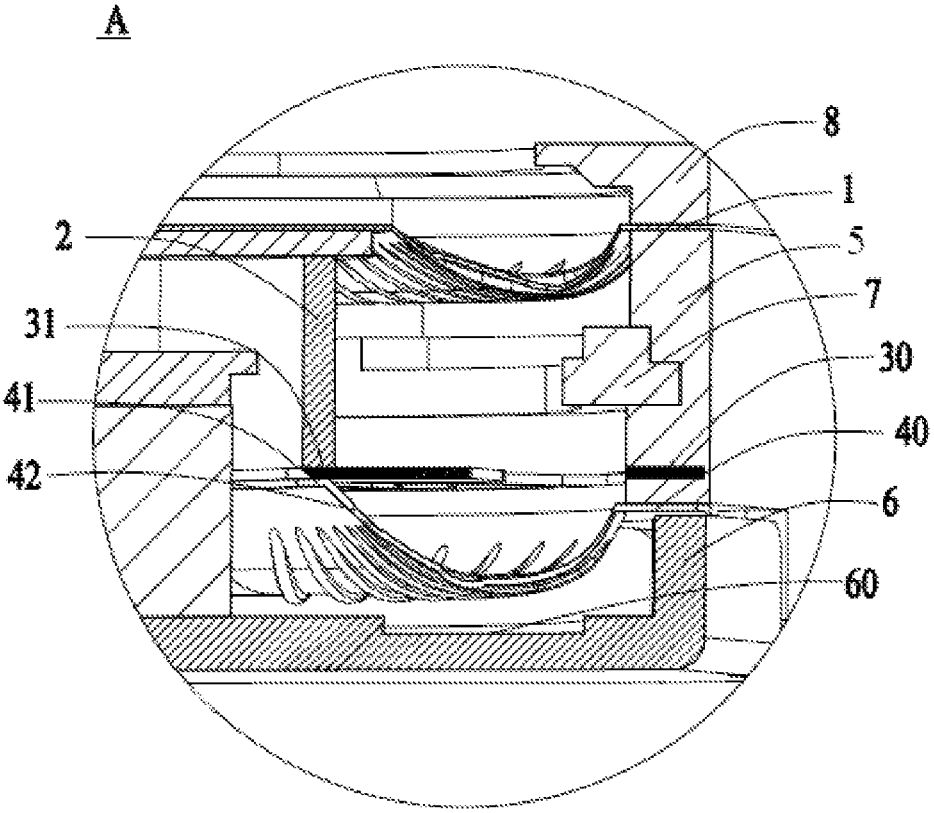
FIG. 8 is an enlarged diagram of the A section of the micro sound generating device shown in FIG. 7.

Further, as shown in FIG. 7 and FIG. 8, the magnetic circuit system of the micro sound generator may include a primary magnet 6 and a magnetic component 7 arranged around the primary magnet 6. The magnetic component 7 and the frame 5 may be formed in an integrated injection molding manner.

Specifically, the primary magnet 6 may be a permanent magnet or other magnetic component. The primary magnet 6 may be installed on a base of the micro sound generator in a bonding or snap-in manner. The magnetic component 7 may be a magnet or a magnetic conduction component. A magnetic field generated by the primary magnet 6 can cover the voice coil 2 through the magnetic component 7, so that the voice coil 2 can vibrate in the case of being powered on to drive the diaphragm to generate sound. Correspondingly, the frame 5 may be formed on the magnetic component 7 in an injection molding manner, so that the magnetic component 7 and the frame 5 can be formed integrally.

More specifically, the magnetic component 7 may be sandwiched between the diaphragm 1 and the support. In this way, the magnetic field generated by the primary magnet 6 may be more uniform, benefiting improvement of the sound quality of the micro sound generator.

Figure 9:
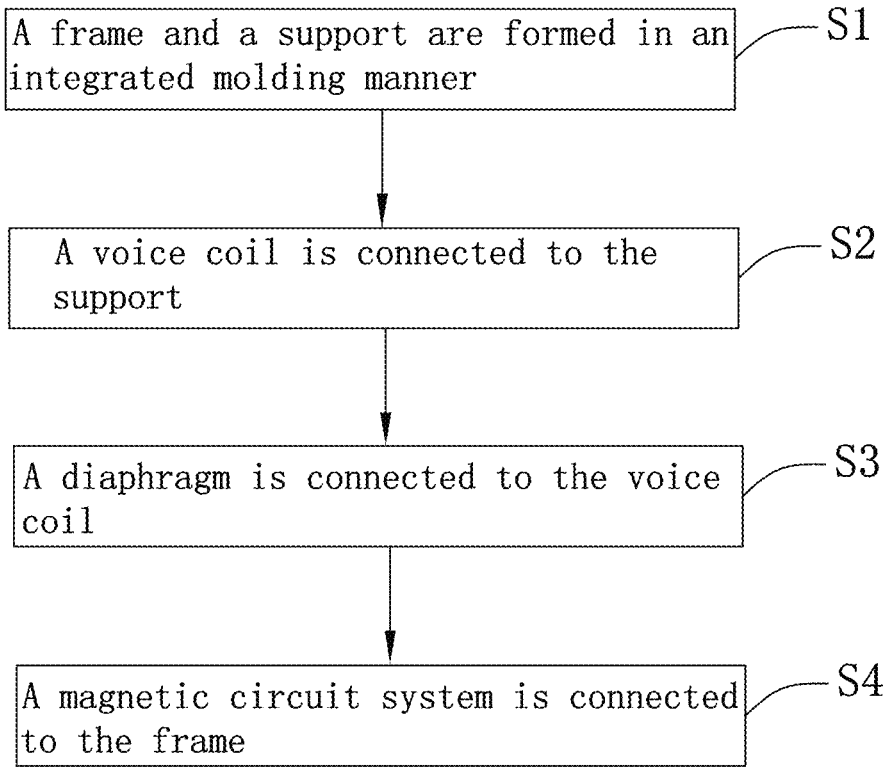
FIG. 9 is a flow schematic diagram of the assembly method of the micro sound generating device provided by the embodiment of the present disclosure.

From the above, as shown in FIG. 9, the present disclosure further provides a method of assembling a micro sound generator. The method includes the following steps.

At step S1, a frame 5 and a support are formed in an integrated molding manner.

Specifically, the support may be a plastic elastic piece or a non-plastic elastic piece, and the frame 5 may be a plastic piece. The frame 5 with a corresponding shape may be formed on the finished support in an injection molding manner. In this way, the working process of separately connecting the support and the frame 5 may be saved, and the manufacturing process of the micro sound generator may be further simplified.

At step S2, a voice coil 2 is connected to the support.

Specifically, the voice coil 2 may be bonded to the support by using a glue or the like. The support may support the voice coil 2 to relatively reduce a vibrating amplitude of the voice coil 2, and further improve the pure sound effect of the micro sound generator.

At step S3, a diaphragm 1 is connected to the voice coil 2.

Specifically, the diaphragm 1 and the voice coil 2 may be connected in a glue bonding manner.

At step S4, a magnetic circuit system is connected to the frame 5.

Specifically, clamping jaws may be provided in corresponding positions of the magnetic circuit system and the frame 5 so that the magnetic circuit system and the frame 5 may be connected by engaging the clamping jaws with each other. Of course, the magnetic circuit system and the frame 5 may also be connected by using a glue or the like to improve the stability of connection therebetween.

It is to be understood, however, that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A micro sound generating device, includes:

a vibrating system;

a magnetic circuit system;

a frame for receiving and fixing the vibrating system and the magnetic circuit system, wherein the vibrating system comprises:

a diaphragm;

a voice coil driving the diaphragm to vibrate; and a support connected with the voice coil, the diaphragm and the support are located on two opposite sides of the voice coil, respectively, and the support and the frame are formed integrally;

the support comprises a flexible circuit board and an elastic supporting portion, the flexible circuit board comprising a first fixing portion, a first supporting portion, and a first elastic portion, with the first fixing portion embedded in the frame, the first fixing portion connected with the first supporting portion by the first elastic portion, the voice coil supported on the first supporting portion, and the first supporting portion supported on the elastic supporting portion; and the elastic supporting portion comprises a second fixing portion located away from the first supporting portion, the second fixing portion is integrally formed with the frame and spaced apart from the first fixing portion.

2. The micro sound generating device as described in claim 1, wherein the voice coil comprises a pair of long edges and a pair of short edges; and the support is arranged on a side corresponding to the short edge.

3. The micro sound generating device as described in claim 1, wherein the first fixing portion and the first supporting portion are located on a same horizontal plane.

4. The micro sound generating device as described in claim 1, wherein the elastic supporting portion is provided with an air vent; a first space and a second space are respectively formed on two opposite sides of the elastic supporting portion, and the first space communicates with the second space via the air vent.

5. The micro sound generating device as described in claim 1, wherein the elastic supporting portion comprises a recessing portion, and a second supporting portion, the second fixing portion is connected with the frame, the second fixing portion is connected with the second supporting portion through the recessing portion, and the flexible circuit board is supported on the second supporting portion.

6. The micro sound generating device as described in claim 5, wherein the second fixing portion and the second supporting portion are located on two horizontal planes, respectively.

7. The micro sound generating device as described in claim 5, wherein the second supporting portion is closer to the diaphragm than the second fixing portion.

8. The micro sound generating device as described in claim 5, wherein the first supporting portion is connected with the second supporting portion, and the flexible circuit board is sandwiched between the diaphragm and the elastic supporting portion.

9. The micro sound generating device as described in claim 1, wherein the magnetic circuit system comprises a primary magnet and a magnetic component arranged around the primary magnet, and the magnetic component and the frame are formed in an integrated injection molding manner.

10. The micro sound generating device as described in claim 9, wherein the magnetic component is sandwiched between the diaphragm and the support.

11. A method of assembling a micro sound generating device, the assembly method being applied to the micro sound generating device of claim 1 and comprising the following steps:

Step S1, forming the frame and the support in an integrated molding manner;

Step S2, connecting the voice coil with the support;

Step S3, connecting the diaphragm with the voice coil; and

Step S4, connecting the magnetic circuit system with the frame.

* * * * *